United States Patent [19]

Ishii

[11] Patent Number: 4,892,143

[45] Date of Patent: Jan. 9, 1990

[54] HEAT EXCHANGER

[75] Inventor: Yutaka Ishii, Gunma, Japan

[73] Assignee: Sanden Corporation, Gunma, Japan

[21] Appl. No.: 299,988

[22] Filed: Jan. 23, 1989

[30] Foreign Application Priority Data

Jan. 21, 1988 [JP] Japan ..... 63-5283[U]

[51] Int. Cl.[4] ..... F28D 1/047; F28F 1/24

[52] U.S. Cl. ..... 165/152; 165/913

[58] Field of Search ..... 165/151, 152, 153, 913; 62/285

[56] References Cited

U.S. PATENT DOCUMENTS 4,353,224 10/1982 Nonogaki ..... 62/285 X 4,756,362 7/1988 Kudoh ..... 165/151

*Primary Examiner*—Robert G. Nilson

*Attorney, Agent, or Firm*—Banner, Birch, McKie & Beckett

[57] ABSTRACT

The present invention is directed to an evaporator for an automotive air conditioning refrigeration circuit. The evaporator includes a serpentined tube through which refrigerant fluid flows, and a corrugated metal fin unit fixedly disposed between parallel planar portions of the serpentined tube. A plurality of louvers are formed through the parallel surfaces of the corrugated metal fin units. The side ends of the louvers terminate a predetermined distance away from the surfaces of the parallel planar portions of the tube. The distance is selected from a range of from over 0.5 mm to under 1.0 mm.

2 Claims, 4 Drawing Sheets

FIG. 7.

| | AN EVAPORATOR SHOWN IN FIG. 5 (PRIOR ART) | AN EVAPORATOR SHOWN IN FIG. 6 (PRESENT INVENTION) |
|---|---|---|
| DISTANCE $\ell+\ell'$ SHOWN IN FIG. 5 AND 6 (mm) | 1.5 | 0.5 |
| VENTILATING RESISTANCE (mm Aq) | 19.5 | 14.2 |

HEAT EXCHANGER

BACKGROUND OF THE INVENTION

1. Technical Field

This invention relates to heat exchangers for refrigeration circuits, and more particularly, to an evaporator for an automotive air conditioning refrigeration circuit.

2. Description of the Prior Art

Evaporators for use in automotive air conditioning refrigeration circuits are known in the art. With reference to FIG. 1, serpentined type evaporator or heat exchanger 10 is shown. Evaporator 10 includes continuous serpentined tube 11 through which refrigerant fluid flows. Serpentined tube 11 includes a plurality of spaced parallel planar portions 12 and a corresponding plurality of curved connecting portions 121. Air flows through evaporator 10 between planar portions 12 in the direction of the arrow shown in FIG. 1. As shown in FIG. 2, the interior space of serpentined tube 11 is divided by a plurality of parallel partition walls 111 into a corresponding plurality of essentially parallel passages through which refrigerant fluid flows. One terminal end of serpentined tube 11 is brazed to fluid inlet pipe 15 which is linked to the output of a compression or an expansion means (for example, a compressor, not shown) of a refrigeration circuit. A second terminal end of serpentined tube 11 is brazed to fluid outlet pipe 16 which is linked to the inlet of the compressor. Refrigerant fluid is provided to serpentined tube 11 from the compressor via inlet pipe 15, flows through each successive planar portion 12 and connecting portion 121 towards outlet pipe 16, and is then returned to the compressor. Of course, the refrigeration circuit may include other elements disposed between the compressor and evaporator 10.

With reference to FIGS. 1, 3 and 4, evaporator 10 further includes corrugated heat receiving metal sheet or fin units 13 disposed between opposed planar portions 12. Fin units 13 are fixed to planar portions 12 by brazing along the lines of contact. Protective side plates 14 are fixed to the exterior side of each of the outside fin units 13. Corrugated fin units 13 are formed in a continuous wave shape with a plurality of essentially parallel planar surfaces **13*a* and curved connecting surfaces 13*b*. Louvers 17 are cut out of and formed through surfaces 13*a* as shown in FIG. 4. Fin units 13 exchange heat from the air flowing through evaporator 10 with the refrigerant fluid flowing through serpentined tube 11. Thus, the air flowing through evaporator 10 is cooled. Louvers 17 increases the heat receiving capacity of fin unit 13**.

With reference to FIG. 5, a cross-section of corrugated fin unit 13 in accordance with the prior art and a cross-section of planar portion 12 are shown. Louvers 17 extend across surfaces **13*a* and terminate at side ends 17*a*, near connecting portions 13*b*. Side ends 17*a* are displaced a distance "1" from the surfaces of planar portions 12. Distance "1" is measured in the horizontal plane and includes the displacement due to connecting portions 13*b* which are in contact with the surfaces of portions 12**

In the prior art of FIG. 5, the distance "1" was selected from a range of over 1.0 mm to under 2.0 mm. However, in the prior art, a considerable amount of condensed water becomes trapped between side ends **17*a* of louvers 17 and the surfaces of parallel portions 12** due to the surface tension of water. The trapped water increases the ventilation resistance of the heat exchanging apparatus, thereby decreasing the heat exchanging efficiency. Additionally, considerable amounts of the compressed water may be scattered into the passenger compartment of an automobile.

SUMMARY OF THE INVENTION

It is an object of this invention to provide an evaporator with reduced ventilation resistance and increased heat exchanging efficiency.

It is a further object of the invention to reduce scattering of water to the passenger compartment of an automobile due to trapped water in the evaporator.

An evaporator in accordance with the present invention includes a serpentined tube through which refrigerant fluid flows. The serpentined tube includes a plurality of parallel planar portions and a corresponding plurality of curved portions linking the planar portions to form a continuous serpentined tube. At least one corrugated metal heat receiving sheet or fin unit is fixedly disposed between opposed parallel planar portions of the tube. A plurality of louvers are formed through the horizontal surfaces of the corrugated fin unit. The side ends of the louvers are located a distance "1" from the surfaces of the planar portions. The distance "1" is in a range between over 0.5 mm and under 1.0 mm.

BRIEF DESCRIPTION OF THE DRAWINGS

FIG. 7 is a table showing the relationship between ventilation resistance and the horizontal distance between the side ends of the louvers and the surfaces of the planar portions of the serpentined tube in accordance with the prior art and in accordance with the present invention. In the table, ventilation resistance is measured according to JIS-D1618 at an airflow rate of 450 cubic meters per hour.

It should be noted that in the above drawing figures, Figures 1–4 show general views of the overall heat exchanger for both the prior art and the present invention.

DETAILED DESCRIPTION OF THE PREFERRED EMBODIMENT

Figure 1:
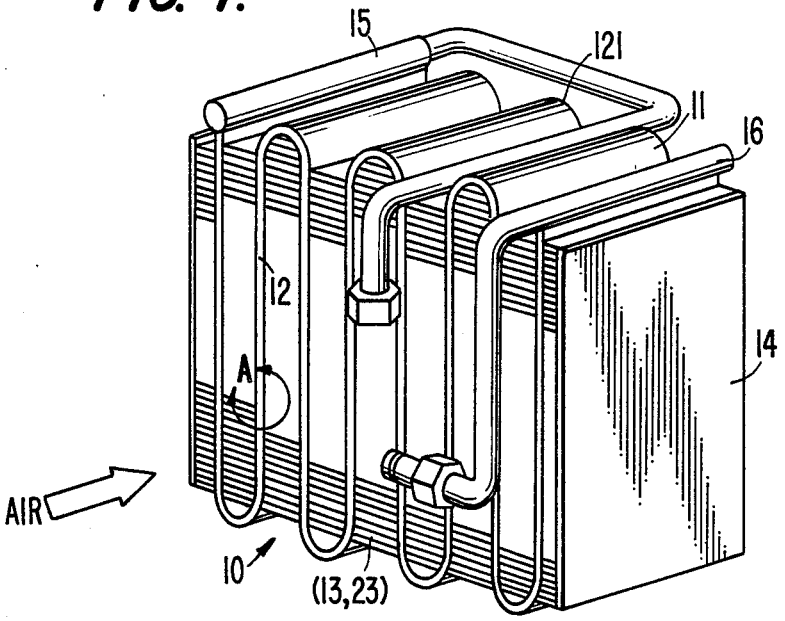
FIG. 1 is a perspective view of a serpentined type evaporator or heat exchanger for use in an automotive air conditioning refrigeration circuit.
Figure 2:
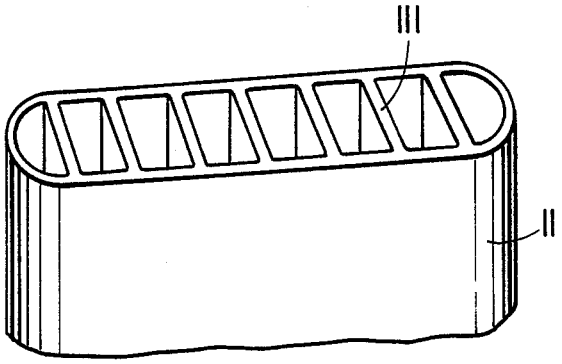
FIG. 2 is a cross-section view of the serpentined tube shown in FIG. 1.
Figure 3:
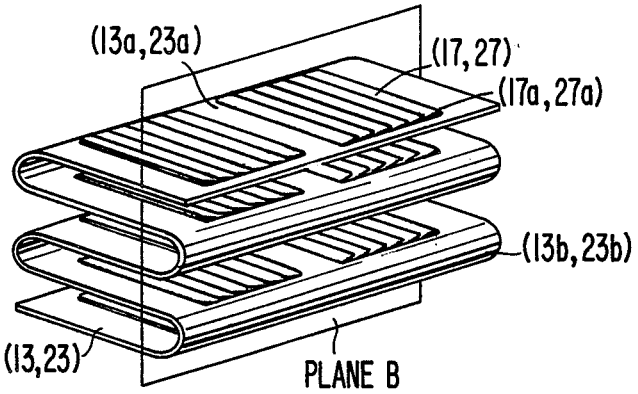
FIG. 3 is a perspective view of a corrugated fin unit disposed between the parallel planar surfaces of the heat exchanger of Figure 1.
Figure 4:
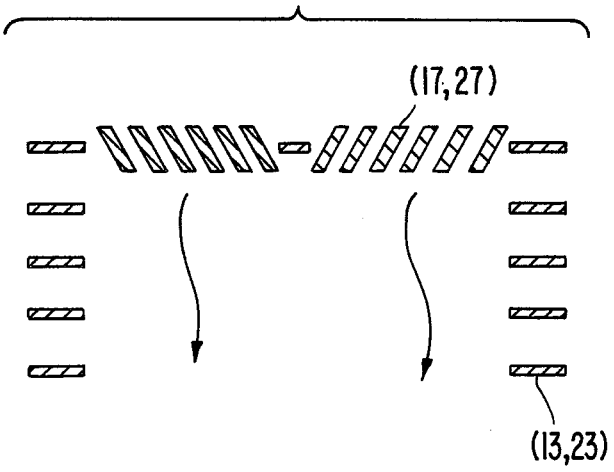
FIG. 4 shows a cross-sectional view taken along plane B in FIG. 3.
Figure 5:
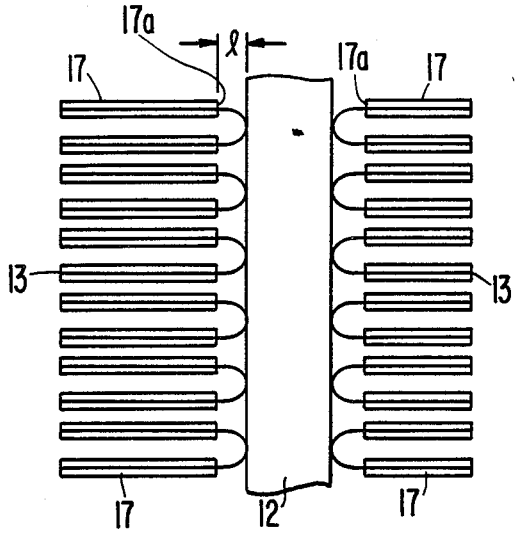
FIG. 5. (PRIOR ART)
FIG. 5 is an enlarged close-up view of the circled area A in the heat exchanger of FIG. 1 in accordance with the prior art.
Figure 6:
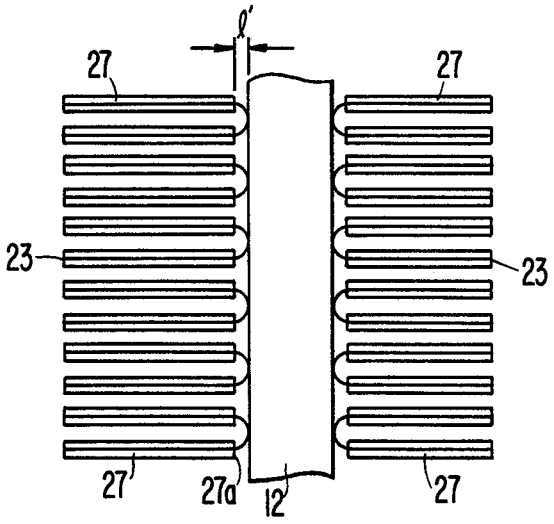
FIG. 6 is an enlarged close-up view of the circled area A shown in the heat exchanger of FIG. 1 in accordance with the present invention.

With respect to FIGS. 1–4, a heat exchanger in accordance with the present invention is shown. The structure of serpentined tube 11 of the present invention is identical to serpentined tube 11 of the prior art. Additionally, the general structure of corrugated fin unit 23 of the present invention is the same as fin unit 13 in the prior art and both numeral are shown in FIG. 1. With respect to FIGS. 3, 4 and 6, corrugated fin unit 23 includes planar parallel horizontal surfaces **23*a* and curved connecting portions 23***b*. Louvers 27 according to the present invention are cut out of and formed through surfaces 23*a*. Louvers 27 extend across surfaces 23 and terminate at side ends 27*a*.

Side ends 27*a* are displaced a distance "1" away from the surfaces of planar portions 12. In the present invention "1" is selected from a range of over 0.5 mm to under 1 mm. As a result, the amount of condensed water which may be trapped between side ends 27*a* of louvers 27 and the surfaces of planar portions 12 is reduced from the prior art. As shown in FIG. 7, in which the distance "1" in the prior art is taken to be 1.5 mm, and the distance "1" in the present invention is taken to be 0.5 mm, the ventilating resistance is reduced from 19.5 (mm Aq) to 14.2 (mm Aq). Thus, the efficiency of the heat exchanger is increased and the problem of water scattering into the passenger compartment of the car is minimized.

The amount of the increase in the heat exchanger efficiency and the amount of the decrease of water scattered to the passenger compartment may be increased by coating the interior surfaces of the heat exchanger with a hydrophilic material. The surfaces to be coated include the surfaces of the corrugated fin units including the louvers, and the surfaces of the parallel planar portions of the serpentined. tube.

The invention has been described in detail in connection with the preferred embodiment. The embodiment, however, is merely for example only and the invention is not restricted thereto. It will be understood by the skilled in the art that other variations and modifications can easily be made with the scope of this invention as defined by the appended claims.

I claim:

1. In an evaporator for use in a refrigeration circuit, said evaporator including a serpentined tube comprising a plurality of spaced, essentially parallel planar portions and a plurality of curved portions interconnecting said parallel portions, refrigerant fluid flowing through said serpentined tube, at least one corrugated fin unit fixedly disposed between opposed parallel planar portions, said fin unit including a plurality of spaced essentially parallel surfaces and a plurality of louvers formed through said surfaces of said corrugated fin unit and terminating a predetermined distance from the surfaces of said parallel portions of said serpentined tube, the improvement comprising:

said predetermined distance being selected from the range of from over 0.5 mm to under 1.0 mm.

2. The evaporator recited in claim 1, the surfaces of said corrugated fin unit including said louvers, and said planar portions of said serpentined tube being coated with a hydrophilic material.

* * * * *